US007695251B2

(12) United States Patent
Marioni

(10) Patent No.: US 7,695,251 B2
(45) Date of Patent: Apr. 13, 2010

(54) ELECTRONIC CONTROL DEVICE FOR A SYNCHRONOUS PUMP

(75) Inventor: Elio Marioni, Dueville (IT)

(73) Assignee: Askoll Holding S.r.l. (IT)

( * ) Notice: Subject to any disclaimer, the term of this patent is extended or adjusted under 35 U.S.C. 154(b) by 478 days.

(21) Appl. No.: 10/568,484

(22) PCT Filed: Aug. 23, 2004

(86) PCT No.: PCT/EP2004/009407

§ 371 (c)(1),
(2), (4) Date: Sep. 22, 2006

(87) PCT Pub. No.: WO2005/019655

PCT Pub. Date: Mar. 3, 2005

(65) Prior Publication Data

US 2007/0122289 A1 May 31, 2007

(30) Foreign Application Priority Data

Aug. 22, 2003 (IT) ..... MI2003A1661

(51) Int. Cl.
*F04B 49/00* (2006.01)

(52) U.S. Cl. ..... 417/36; 417/40; 417/41; 417/423.3; 417/17; 417/44.11

(58) Field of Classification Search ..... 417/36, 417/40, 41, 423.3, 17, 44.11
See application file for complete search history.

(56) References Cited

U.S. PATENT DOCUMENTS 3,525,913 A * 8/1970 Nicolantonio et al. ..... 318/721
4,099,103 A * 7/1978 Seeger et al. ..... 318/85
4,241,299 A * 12/1980 Bertone ..... 318/474
5,015,151 A * 5/1991 Snyder et al. ..... 417/18
5,434,491 A * 7/1995 Marioni ..... 318/700
5,772,205 A 6/1998 Coldebella et al.
6,146,109 A * 11/2000 Davis et al. ..... 417/244
6,194,852 B1 * 2/2001 Lovatt et al. ..... 318/400.14
6,390,780 B1 * 5/2002 Batchelder et al. ..... 417/36

(Continued)

FOREIGN PATENT DOCUMENTS

DE 36 42 727 A1 6/1988
EP 1 054 506 A2 11/2000

*Primary Examiner*—Devon C Kramer
*Assistant Examiner*—Christopher Bobish
(74) *Attorney, Agent, or Firm*—Akerman Senterfitt

(57) ABSTRACT

The invention relates to an electronic driving device (20) for turning on and off a synchronous pump, that is a pump (15) comprising a synchronous electric motor (1) with a permanent-magnet rotor (8), comprising:—at least a static power switch (17) inserted in series between the motor (1) and an AC electric power supply source (Vp); and—a processing unit (16) having at least an input receiving a synchronism signal (V) and a control output connected to said switch (17); characterized in that it is enabled by a signal emitted by a float level sensor (40) and includes an input receiving a signal (a) by a position sensor (21) detecting the rotor (8) polarity and position; the pump turn-on and off being regulated according to the signal emitted by said level sensor (40) and to a measured difference between a critical load angle (8) and a current load angle computed during different working conditions of the pump.

13 Claims, 5 Drawing Sheets

U.S. PATENT DOCUMENTS 6,452,202 B1 * 9/2002 Eom ..... 250/574
6,566,829 B1 * 5/2003 Naidu et al. ..... 318/432
6,625,519 B2 * 9/2003 Goodwin et al. ..... 700/282
6,710,562 B1 * 3/2004 Kalb et al. ..... 318/434
2002/0090303 A1 * 7/2002 Scott ..... 417/36
2003/0076068 A1 * 4/2003 Pollock et al. ..... 318/685

* cited by examiner

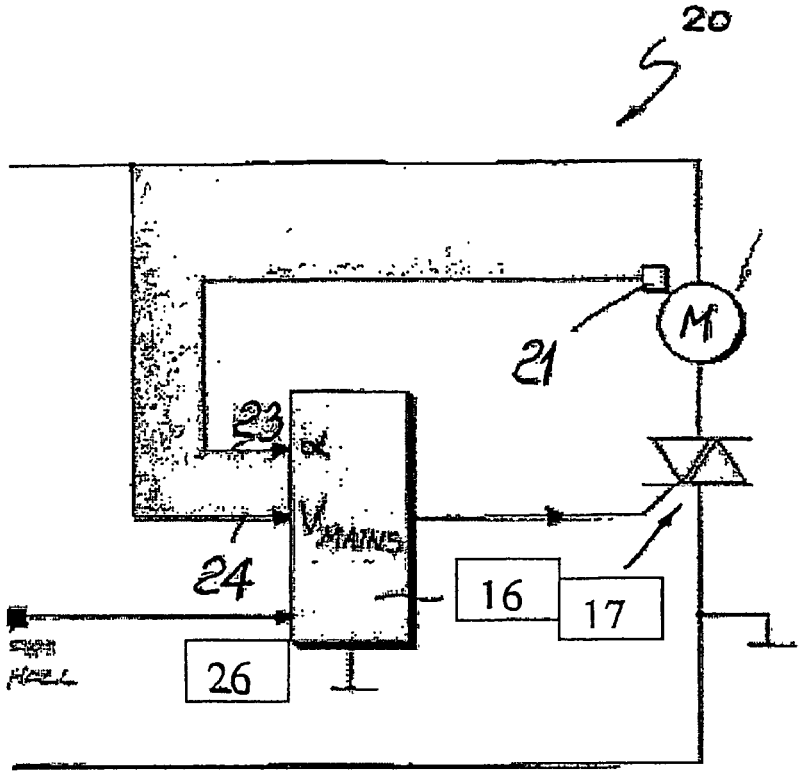
FIG. 3
FIG. 4
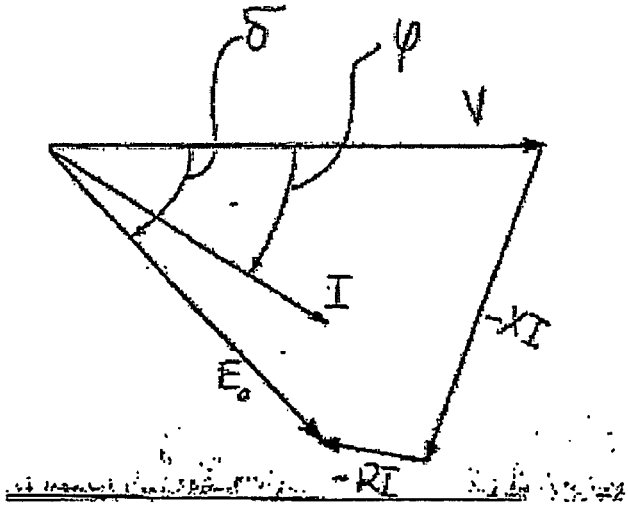

ELECTRONIC CONTROL DEVICE FOR A SYNCHRONOUS PUMP

FIELD OF APPLICATION

In its more general aspect the present invention relates to a circulation pump driven by a permanent-magnet synchronous electric motor and equipped with an electronic driving device for controlling the turn-on and turn-off phases.

More particularly, the invention relates to a synchronous immersion pump particularly, but not exclusively, suitable for a submersed installation in drain basins or tanks or in a sewage floodway. The following description is made with reference to this specific field of application for convenience of illustration only.

The invention relates to a turn-on and turn-off electronic device of a synchronous pump, particularly a pump comprising a synchronous electric motor with a permanent-magnet rotor, of the type comprising at least a static power switch inserted in series between the motor and an AC electric power supply source and a processing unit having at least an input receiving a synchronism signal and a control output connected to said switch.

PRIOR ART

As it is well known to the skilled in the art, immersion pumps are used to rapidly pump down sewage collection tanks or when there the need to discharge fluids that are flowing in a recess and whose draining requires the fluid to exceed a given head.

A typical application in the civil field is represented by pumping down sewage collection basins or tanks positioned in underground rooms located at a lower level than the sewerage network.

Other applications occur in the building field for dumping down water wells formed after digging for making foundations.

A float control device comprising a level sensor of the fluid to be discharged is generally associated to an immersion pump; the sensor allows the pump to be started when the fluid level is kept above a predetermined threshold and the pump to be stopped when the fluid level reaches a minimum value.

Such pumps are advantageously realised with asynchronous motors, but the cost thereof and the cost of the components associated therewith has become exorbitant with respect to the performances which can be obtained with this kind of motors.

In recent years the most reliable, stable, durable and practical to use immersion pumps have been realised with permanent-magnet synchronous motors.

Although advantageous under several aspects with respect to asynchronous motors, these motors have the drawback of a difficult start up phase at turn-on since the rotor must rapidly pass from a zero-speed starting state to a steady, or synchronism, state, wherein the rotation frequency is phased with the electric power supply source frequency.

In other words, at the normal 50 or 60 Hz frequency of the electric power supply network, the rotor must be capable to reach the synchronism speed in a period of time corresponding to a period of the electric power supply signal divided by the number of pole pairs.

This requirement is objectively difficult to meet, mainly when the rotor must also overcome an initial load inertia.

Several solutions have been adopted to overcome this drawback; most of them provide the use of complex and complicated electronic driving circuits regulating the current flow fed by the stator coils during the motor start up transient.

These solutions cannot be adopted in synchronous motors to be used on low-cost pumps.

Moreover, immersion pumps also have the problem of how effectively regulating the turn-off phase, in order to avoid damages to the pump, for example when it starts the intake of some air.

Known driving devices are not always capable to effectively regulate also the turn-off phase.

More particularly, the turn-off driving phase does not often take into proper consideration the pump fatigue state due, for example, to the intake of water/air mixtures with subsequent risk of operation under vacuum conditions.

The technical problem underlying the present invention is to provide an electronic driving device for the turn-on and turn-off phases of a synchronous pump, particularly for an immersion pump, having such structural and functional features as to ensure a quick reaching of the synchronism state after a rapid turn-on phase and an effective reaching of the turn-off state avoiding stressing the device components and overcoming the limits of the solutions presently provided by the prior art.

Another aim of the invention is to realise a pump which can reach said features at a very low cost, with a lower number of components, and optimising the current consumption in all operating conditions.

SUMMARY OF THE INVENTION

The solution idea underlying the present invention is to exploit, for the turn-on phase and for the turn-off phase, both an enabling signal coming from a first float level sensor, enabling the pump turn-on, and a signal of a second sensor controlling the rotor position. In said turn-off phase the float position recovery is controlled by means of the first sensor and the critical load angle is measured by calculating the phase displacement between the signal of said second rotor position sensor (also suitable for controlling the motor) and a signal coming from the mains synchronism. More particularly, the phase displacement calculation is indirectly performed between a signal corresponding to the counter electromotive force and a signal corresponding to the mains supply voltage.

According to this solution idea, the technical problem is solved by a device as previously indicated and characterised in that it is interlocked to a float level sensor and in that it comprises a position sensor to detect the rotor polarity and position and to send a corresponding signal to said processing unit; the pump turn-off being regulated according to a signal emitted by said level sensor, received on an input of said unit and to the measure of a critical load angle obtained by the phase displacement between the position sensor signal and said synchronism signal.

The features and advantages of the electronic device for driving the turn-on and turn-off phases according to the invention will be apparent from the following description of an embodiment thereof given by way of non limiting example with reference to the attached drawings.

BRIEF DESCRIPTION OF THE DRAWINGS

FIG. 3 is a schematic block view of an electronic device for driving the turn-on and turn-off phase of the motor of FIG. 1;

FIG. 4 is a schematic view of a vector diagram pertaining to the quantities involved in the motor of FIG. 1;

DETAILED DESCRIPTION

Figure 1:
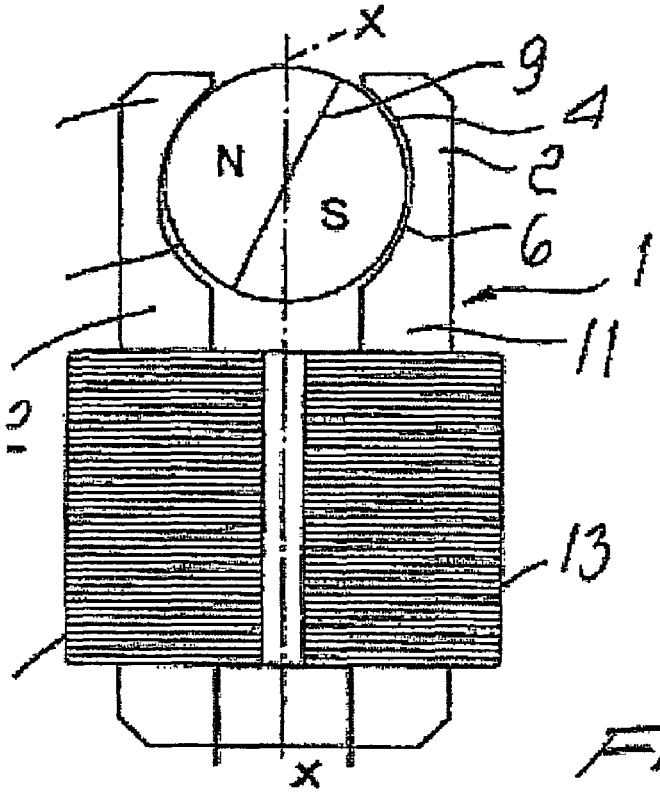
FIG. 1 is a schematic view of a synchronous motor with a permanent-magnet rotor and a two-pole stator incorporated into an immersion pump driven by the electronic device according to the present invention.
Figure 2:
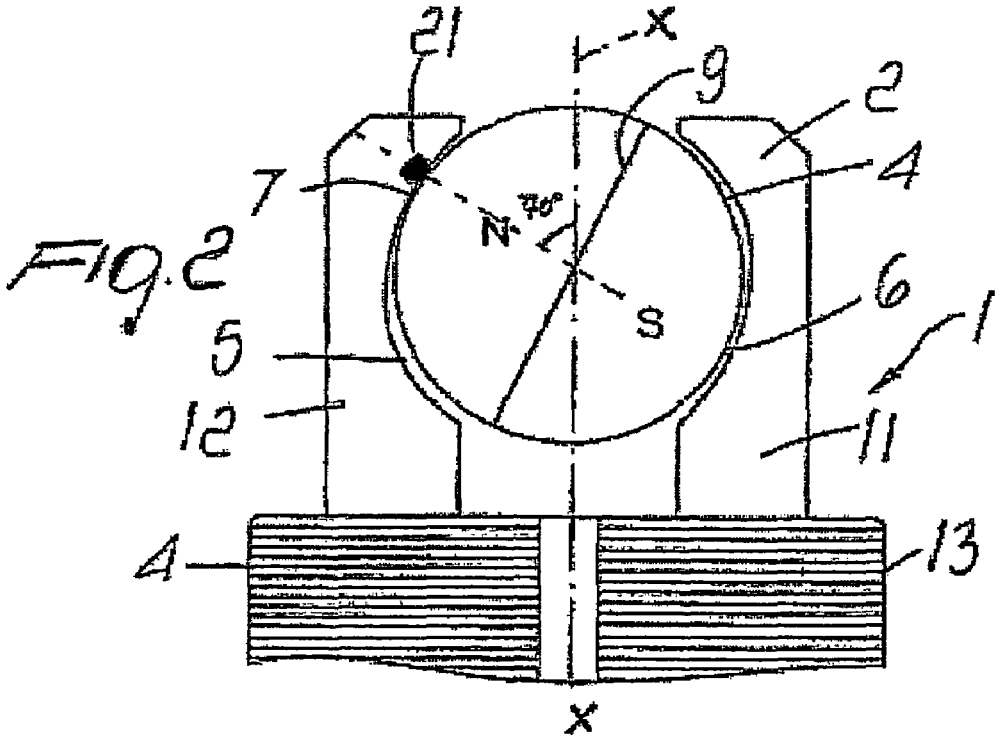
FIG. 2 is an enlarged-scale schematic view of a detail of the motor of FIG. 1.

With reference to the figures, and particularly to the examples of FIGS. 1 and 2, a synchronous electric motor for a circulation pump 15, for example an immersion pump installed in a submersed way in fluid collection basins or tanks is globally and schematically indicated with 1.

The motor 1 can be both of the mechanical turn-on type and of the electronics-aided turn-on type The pump 15 is started by the synchronous electric motor 1 which is driven by a driving electronic device 20 realised according to the present invention.

A level sensor 40 of the fluid wherein the pump is submersed is associated to the electronic device 20. This sensor 40 can be realised in several ways, for example: mechanical or electromechanical, magnetic (Hall effect or READ sensor), optical, piezoelectric or radar. Preferably, a magnetic level sensor 40 is used in the pump of the present invention, which will be described in detail hereafter with particular reference to FIG. 5.

Independently from the level sensor technology, for the aims of the present invention it is sufficient to consider this sensor 40 as the element enabling the pump to be driven both in the turn-on phase and in the turn-off phase.

The electric motor 1 of the pump 15 comprises a stator 10 and a substantially cylindrical permanent-magnet central rotor 8. The stator 10 comprises two unbalanced pole pieces 2, 3 with two opposed broader air gap regions 4, 5 with respect to other two opposed air gap regions 6, 7 being consecutive and asymmetrical with respect to the previous ones.

The rotor poles N, S are divided by an ideal plane indicated in the drawings with the line 9 and whose position, in the rest step, does not coincide with a median axis X-X of the motor 1, but it is sloping with respect to the latter by a predetermined angle, for example 20°.

With this configuration the rotor 8 is unidirectional since it is favoured to move in a predetermined direction in the turn-on or start up phase.

Two stator windings 13, 14 are provided at the respective bases 11, 12 of the two pole shoes 2, 3 and connected in series to each other in order to be fed by a same AC electric power supply source Vp.

The turn-on and turn-off electronic device 20 is schematically shown in FIG. 3 and comprises a processing unit 16 having a control unit connected to drive a static power switch 17, for example a TRIAC connected in series to one of the stator windings. In the embodiment being here described by way of non limiting example, the switch 17 is inserted in series between the electric power supply source Vp and the motor 1.

The processing unit 16 receives on an input 24 a first signal V derived from the electric power supply source Vp. This signal V is substantially a synchronism indicator.

The unit 16 received on an input 23 also a second signal $\alpha$ coming from a sensor 21 detecting the polarity and position of the rotor 8 both in the rotation step and in the stall step.

The sensor 21 is preferably a field-effect magnetic sensor, for example a Hall sensor, even if other different sensor typologies can be used.

The unit 16 receives on a third input 26 an enabling signal coming from the level sensor 40 of the fluid to be discharged, which will be described in detail hereafter.

Figure 7:
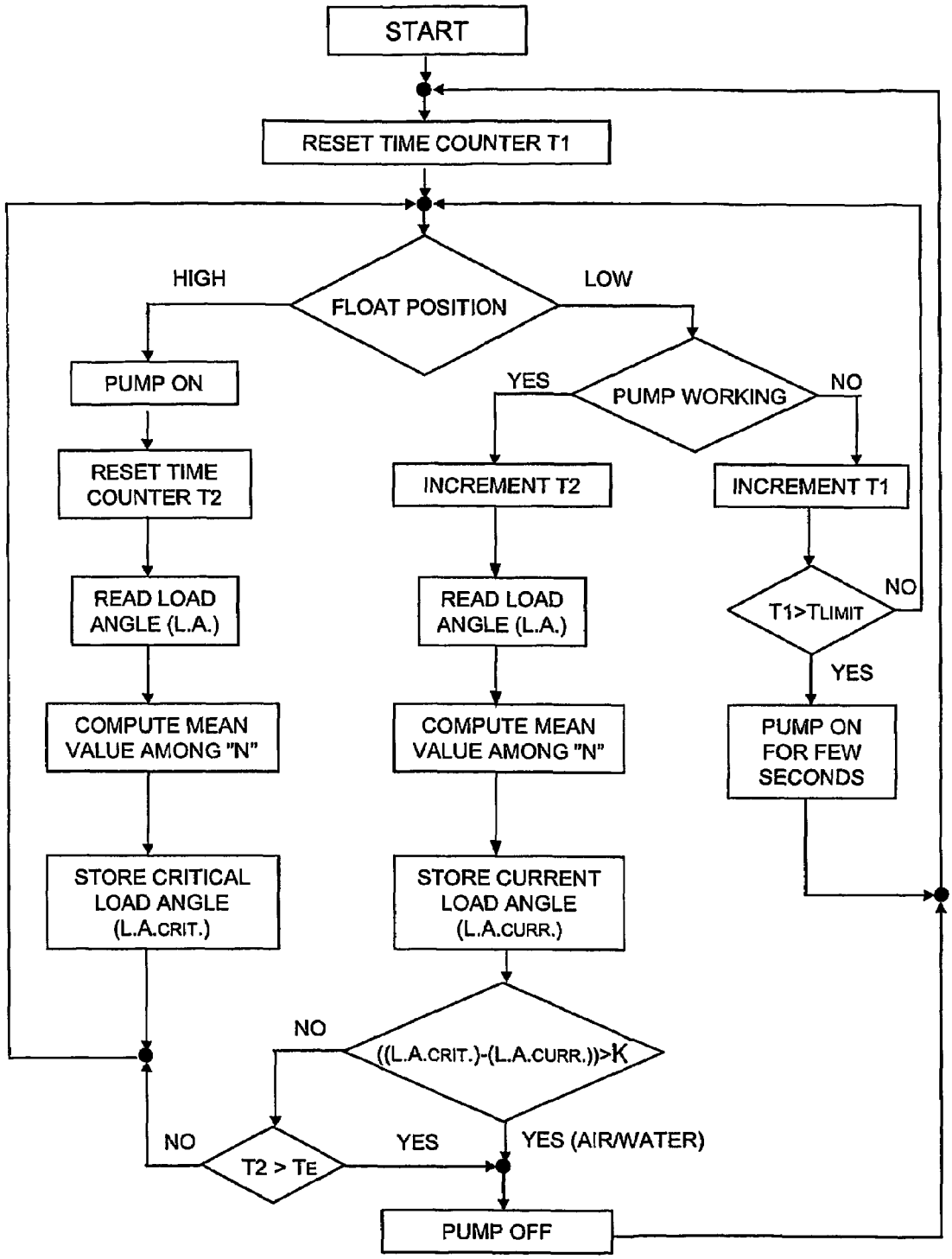
FIG. 7 is a flow chart showing the driving steps of the electronic device of the present invention according to the indications of the float level sensor and the operating conditions of the pump synchronous electric motor.

The unit 16 essentially comprises converters of the analogue to digital type, to turn the signals V and $\alpha$ into digital signals, digital counters and a logic network, not shown in the drawings, allowing calculations to be performed on said digital signals according to a driving algorithm that will be disclosed with reference to the flow chart of FIG. 7. As an alternative, the unit 16 may include an electronic microcontroller for running the driving algorithm.

The electronic device 20 is enabled by the level sensor 40 that, as previously mentioned, can be realised in several ways, for example: mechanical or electromechanical, optical, piezoelectric or radar.

Figure 5:
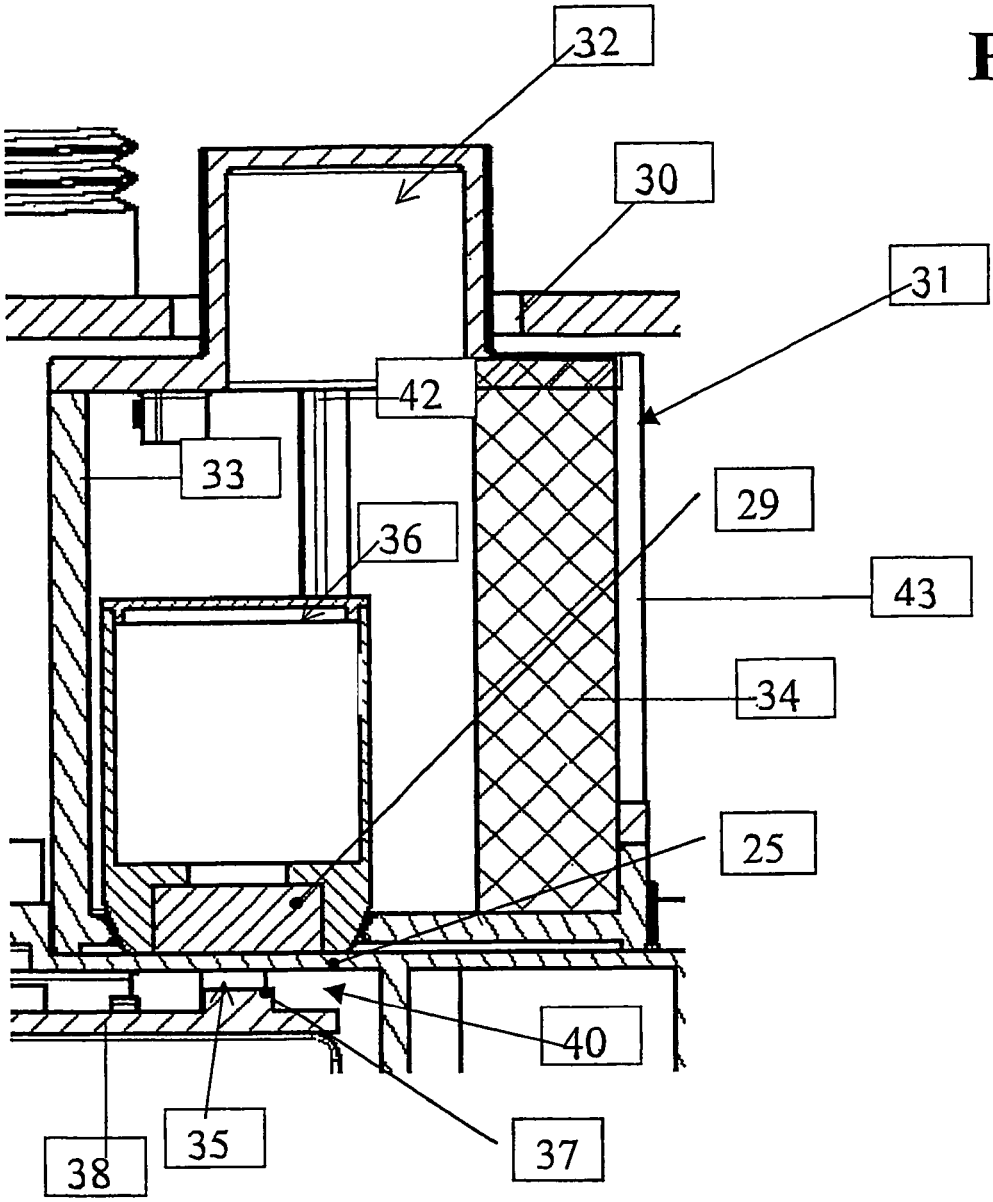
FIG. 5 is a sectional view of a float level sensor device associated to the immersion pump of the present invention.
Figure 6:
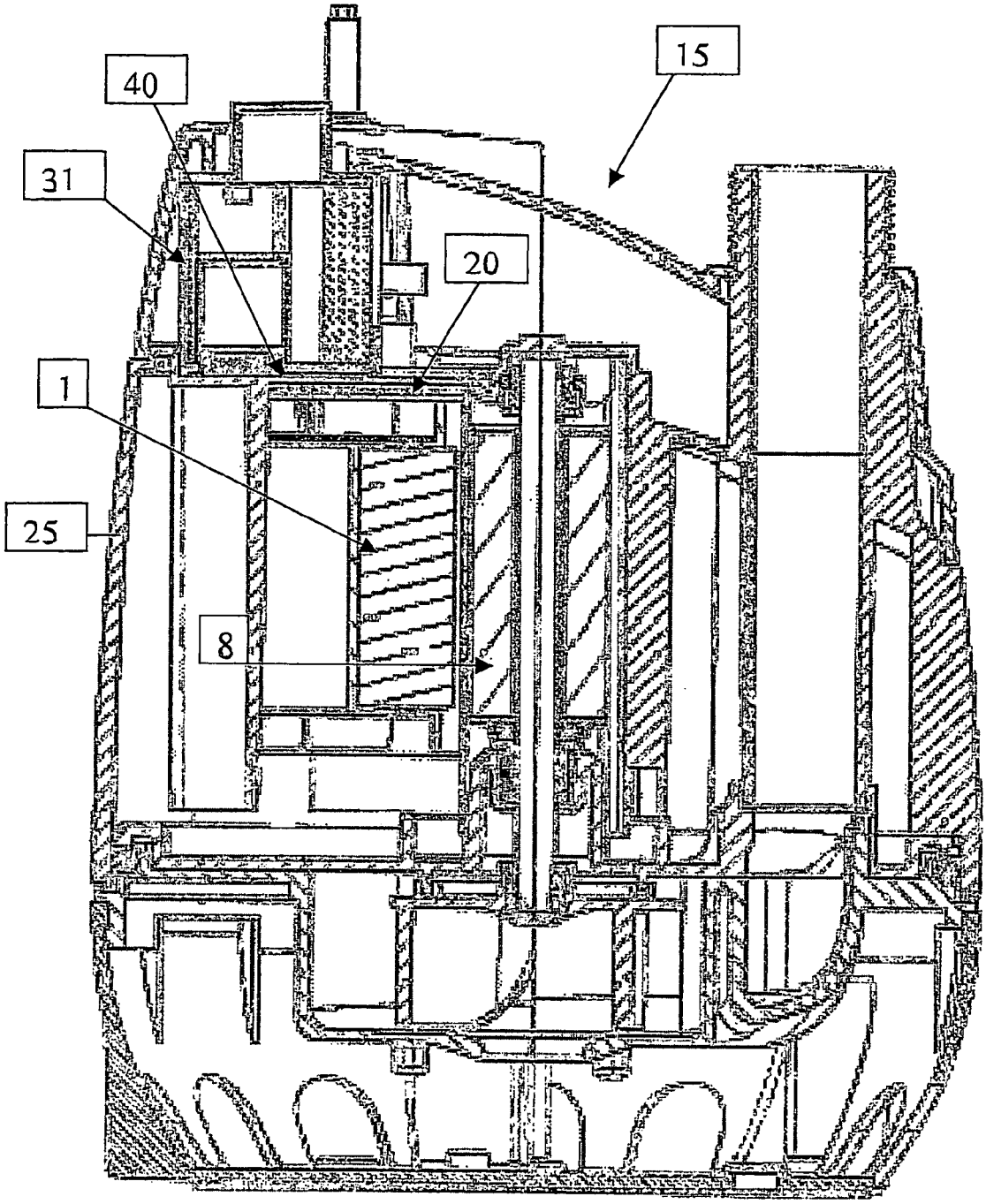
FIG. 6 is a sectional view of an immersion pump incorporating the motor of FIG. 1, the electronic device of FIG. 3 and the sensor device of FIG. 5.

However, according to the invention and as shown in FIGS. 5 and 6, the sensor 40 is preferably an Hall-effect magnetic sensor.

Advantageously, the sensor 40 comprises a portion housed in an envelope 31 located in the pump body upper part.

The envelope 31 comprises a substantially-cylindrical-cup-shaped base portion 33 rotary mounted on the pump body upper part, as well shown in FIG. 6.

The base 33 has a side portion equipped with a grate 43 putting the internal part of the envelope 31 in fluid communication with the external environment. Internally, close to this side portion, a semi-cylinder-shaped filter element 34 is provided whose function will be explained hereafter. The filter 34 is kept in position by two opposed bulkheads 42 partially projecting towards the internal part of the envelope 31.

A float 36 is housed inside the envelope 31.

The float 36 is formed by an hollow cylindrical plastic body and it is equipped in its lower part with a permanent magnet 29.

A lid 30 is fitted on the base 33 defining therewith a chamber of the envelope 31 wherein the float 36 can freely move in the portion not being occupied by the filter 34. The lid 30 has a knob 32 which can be handled by a user in order to regulate, with a predetermined angle, for example between 90° and 180°, the float 36 position on the horizontal plane.

More particularly, the float 36 can move freely in the chamber delimited by the two bulkheads 42 projecting inside the envelope 31.

The water inflow determining the float 16 movement is ensured by the grate-shaped wall 43. The filter 34 is located within the grate-shaped wall 43 in order to prevent suspended bodies or other pollutants from contacting the float 36 and jeopardising the free movement thereof.

An electronic board 38, suitable for housing the pump turn-on and turn-off electronic device 20, is advantageously housed within the pump body 25 in a position just underlying the float sensor 40.

As it is well shown in FIG. 5, the board 38 is equipped at one end with a Hall probe 37 housed on a board surface in a position facing the permanent magnet 29 of the float 36.

However, the mobile position of the float 16 can provide a reciprocal separation and approach of the magnet 29 with the Hall probe 37, but also a misalignment between the probe 37 and the magnet 29 caused by a manual intervention on the knob 32 of the lid 30.

An insulating resin layer 35 separates the board 38 from the internal wall of the pump body 25, just between the Hall probe 37 and the magnet 29.

Moreover, also the upper wall of the pump body 25 insulates the Hall probe 37 and the magnet 29 so that all the live circuit parts have a double insulation with respect to the internal area of the envelope 31 containing water.

Advantageously, according to the invention, the motor 1 turn-on phase is regulated according to the synchronism signal and the signal provided by the Hall-effect sensor.

On the contrary, concerning the turn-off phase of the motor 1, it is regulated according to the signal coming from the level sensor 40 and the variations of the load applied to the pump.

For example, the turn-off of the pump 15 according to the invention can be predetermined upon detecting, during the intake, an air bubble, which definitely changes the pump load and which could cause a vacuum operation with damage risk.

More particularly, in the unit 16 a measure is performed of the so-called "load angle" representing the time phase displacement of the first signal V, indicating the supply voltage of the motor 1, and the counter electromotive force induced by the rotor on the stator in the synchronous rotation step. More precisely, however, the time phase displacement measured in the unit 16 is complementary to the load angle 8 just because the rotor induction, and not the counter electromotive force, is measured, by means of a Hall probe, which are in fact two quantities being, as the skilled man knows, complementary.

The measure of this phase displacement is thus indirectly performed by using the signal provided by the Hall-effect sensor. The processing of these signals inside the unit 16 allows the turn-off of the motor 1 and thus of the pump 15 to be controlled.

FIG. 4 schematically shows a vector diagram allowing the calculations performed in the unit 16 to be better understood. The inductance of the stator windings is indicated with X;

R is the resistance of these windings;

I is the supply current;

V is the supply voltage;

$\delta$ is the load angle;

$\phi$ is the phase displacement between the supply voltage and the current;

Eo is the back electromotive force BEMF.

The device 20 according to the invention allows driving at best both the turn-on and turn-off phases of the pump.

To this aim, both the enabling signal coming from the float level sensor 40, enabling the pump turn-on, and the signal of the Hall sensor 21, controlling the rotor position, are processed in the unit 16.

In particular, in the turn-off phase the return in position of the float of the level sensor 40 is controlled at first and the critical load angle ($\delta$) is also measured by calculating the phase displacement between the position sensor 21 signal (also suitable for controlling the motor) and a signal V coming from the mains synchronism.

The pump of the present invention may be driven according to the indications contained in the EP application No. 02425122; however, a specific driving algorithm has been provided to reach the scope of the invention.

As may be appreciated from the flow chart of FIG. 7, the first step of the driving algorithm on starting provides a reset of a first counter T1.

A first test phase Q1 evaluates the high or low position of the float associated to the float level sensor and turns on the pump is the float level is high or passes the control to a second test step Q2 if the float level is low.

When the pump is ON a second counter T2 is reset.

Then the load angle is read from the Hall sensor 21 and a mobile mean value is computed using a plurality of N read values of load angle.

A critical or "limit" load angle is stored in a memory unit or location to later compute a difference between such a critical value and the current value of the load angle.

A different subroutine is run when the result of the first test step indicates a low position of the float and the second test step Q2 evaluates if the pump is in a on or in a off state.

If the pump is ON, the second counter T2 is incremented and the load angle value is read by the Hall sensor 21.

Then a current mobile mean value is computed using a plurality of N read or sampled values of load angle.

The resulting current mean value is stored in a second memory unit or location.

A third test step Q3 is provided to evaluate if the difference between the stored critical mean value of the load angle and the current mean value of the load angle is greater than a predetermined K value.

Such a K value is obtained according to experimental results relating to a possible dangerous presence of a mixture of air and water inside the pump drastically reducing the pump efficiency.

If the result of the third test step Q3 is YES, meaning that the difference between the critical load angle and the current load angle is greater than K and indicating the presence of a fluid with air and water, then the pump is turned off.

On the contrary, if the result of the third test step Q3 is NO, a further test step is performed on the value T2 counted by the second counter. If T2 is greater than Te that is a predetermined time limit for an emergency turn off or stop of the pump, then the pump is immediately turned off.

If T2 is minor than Te, the control is returned to the first test step Q1.

Attention should be paid to a further subroutine starting after a possible OFF result of the second test step Q2.

If the pump is in the OFF state, the first counter T1 is incremented and a subsequent test about the value of T1 is performed.

If the value of T1 is greater than a predetermined period of time Tlimit, for instance twenty-four hours, meaning that the pump is off since a long period of time, the pump is turned on for a short time period, for instance five seconds. Then the control is returned upstream of the reset block resetting the value T1.

The control is left to the first test step Q1 when the result of the test on the counted value T1 is negative.

Thus, it may be appreciated that the driving algorithm takes care of the signal input coming in from float level sensor and the signal input coming in from the angular position sensor of the motor. Time limits are also provided for keeping under rigid control the working time or inactivity of the pump.

The driving device for turning-on and off the pump according to the present invention allows the immersion pump to be effectively driven avoiding vacuum operation situations.

The lack of a current sensor allows a device to be realised with a lower number of components and the pump reliability to be increased.

Obviously, also the further advantage of a lower manufacturing cost of the whole turn-on and turn-off device and pump derives from the previous advantages.

Moreover, the pump equipped with the integrated level sensor is more compact and it substantially performs a function being previously required by external components—for example the fluid collection basin is no more required.

The invention claimed is:

1. An electronic driving device for turning on and off a synchronous pump comprising a synchronous electric motor with a permanent-magnet rotor, comprising:

at least a static power switch inserted in series between the motor and an AC electric power supply source; and a processing unit having at least an input receiving a synchronism signal (V) and a control output connected to said static power switch;

wherein the electronic driving device is controlled by a signal emitted by a float level sensor and includes an input receiving a signal (α) by a position sensor detecting the rotor polarity and position;

wherein the pump turn-on and off is regulated according to the signal emitted by said float level sensor and to a measured difference between a critical load angle (δ), computed in a working condition of the pump in which the signal emitted by the float level sensor corresponds to a high level condition, and a current load angle;

wherein said critical load angle (δ) is a reference value for normal operation of the pump, with no risk of operation under vacuum conditions, and the pump is turned off when the difference between the stored critical load angle and a current mean value of the load angle is greater than a predetermined value.

2. The device according to claim 1, wherein said position sensor is a Hall-effect sensor

3. The device according to claim 1, wherein the motor comprises rotor poles divided by an ideal plane whose rest position is orthogonal to the position of said position sensor.

4. The device according to claim 1, wherein said float level sensor comprises a Hall probe.

5. The device according to claim 1, wherein the float of said level sensor is incorporated in an envelope, externally associated with the body of the pump and the sensor element of said level sensor is housed in the pump body in correspondence with said float.

6. The device according to claim 5, wherein said float is equipped in its lower part with a permanent magnet.

7. The device according to claim 1, wherein said pump is an immersion pump.

8. The device according to claim 1, wherein said electronic device is housed on an electronic board positioned inside the pump body in a position just underlying the float level sensor.

9. The device according to claim 1, wherein the critical and current load angles are obtained from a phase displacement between back electromotive force and said synchronism signal (V), said phase displacement being indirectly measured in said processing unit by detecting the rotor inductance, by means of said position sensor, said rotor inductance being complementary to the back electromotive force.

10. The device according to claim 1, wherein the pump is immediately turned off if the value of a counter (T2) is greater than a predetermined time limit (Te) defined for an emergency stop.

11. The device according to claim 1, wherein said critical load angle (δ) is a mean value among N sampled values.

12. The device according to claim 1, further comprising a first time counter (T1) that is incremented every time instant wherein the float level sensor is low and the pump is off to check the inactivity time period of the pump and turn it on for a predetermined short time period.

13. An electronic driving device for turning on and off a synchronous pump comprising a synchronous electric motor with a permanent-magnet rotor, comprising:

at least a static power switch inserted in series between the motor and an AC electric power supply source; and a processing unit having at least an input receiving a synchronism signal (V) and a control output connected to said static power switch;

wherein the electronic driving device is controlled by a signal emitted by a float level sensor and includes an input receiving a signal (α) by a position sensor detecting the rotor polarity and position;

wherein the pump turn-on and off is regulated according to a driving algorithm comprising the steps of:

evaluating the high or low position of a float associated to the float level sensor;

if the float level is high storing a critical load angle in a memory unit;

if the float level is low evaluating the difference between the stored critical load angle and a current mean value of the load angle;

if the difference is greater than a predetermined value turn off the pump.

* * * * *